US007558494B2

(12) United States Patent
Hatakeyama

(10) Patent No.: US 7,558,494 B2
(45) Date of Patent: Jul. 7, 2009

(54) IMAGE FORMING APPARATUS

(75) Inventor: Motonobu Hatakeyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 254 days.

(21) Appl. No.: 11/447,198

(22) Filed: Jun. 6, 2006

(65) Prior Publication Data

US 2006/0280513 A1 Dec. 14, 2006

(30) Foreign Application Priority Data

Jun. 10, 2005 (JP) ..... 2005-170501

(51) Int. Cl.
*G03G 15/08* (2006.01)

(52) U.S. Cl. ..... 399/27; 399/28; 399/120

(58) Field of Classification Search ..... 399/9, 399/24, 25, 27, 28, 29, 81, 107, 119, 120; 347/19

See application file for complete search history.

(56) References Cited

U.S. PATENT DOCUMENTS

| | | | | |
|---|---|---|---|---|
| 6,917,769 | B2 * | 7/2005 | Hattori | 399/27 |
| 6,957,023 | B2 * | 10/2005 | Kinoshita et al. | 399/27 |
| 7,058,320 | B2 * | 6/2006 | Yamamoto et al. | 399/27 |
| 7,113,711 | B2 * | 9/2006 | Okamura | 399/27 |
| 7,181,147 | B2 * | 2/2007 | Kinoshita et al. | 399/27 |
| 7,218,866 | B2 * | 5/2007 | Hayashi et al. | 399/12 |
| 7,218,871 | B2 * | 5/2007 | Ogata | 399/27 |
| 7,224,914 | B2 * | 5/2007 | Ushiroji et al. | 399/27 |
| 7,245,842 | B2 * | 7/2007 | Hino | 399/49 |
| 7,263,300 | B2 * | 8/2007 | Ishii et al. | 399/27 |
| 7,286,775 | B2 * | 10/2007 | Utsumi et al. | 399/27 |
| 2002/0037173 | A1 | 3/2002 | Kakeshita | |
| 2004/0114946 | A1 | 6/2004 | Koyama et al. | |

FOREIGN PATENT DOCUMENTS

| | | |
|---|---|---|
| JP | 11-2963 | 1/1999 |
| JP | 2003-050505 | 2/2003 |

* cited by examiner

*Primary Examiner*—Hoan H Tran
(74) *Attorney, Agent, or Firm*—Rabin & Berdo, P.C.

(57) ABSTRACT

An image forming apparatus includes a developer reservoir, a detector, a computing section, a display unit, and a controller. The developer reservoir holds developer therein. The detector detects when the developer decreases to a first amount (i.e. toner-low level) The computing section computes current accumulated developer usage. The current accumulated developer usage is displayed on the display unit. The controller controls the display unit to display the current accumulated developer usage. When the detector detects the first amount, the controller controls the display unit to display a first value of the current accumulated developer usage that has been consumed until the first amount is detected.

12 Claims, 14 Drawing Sheets

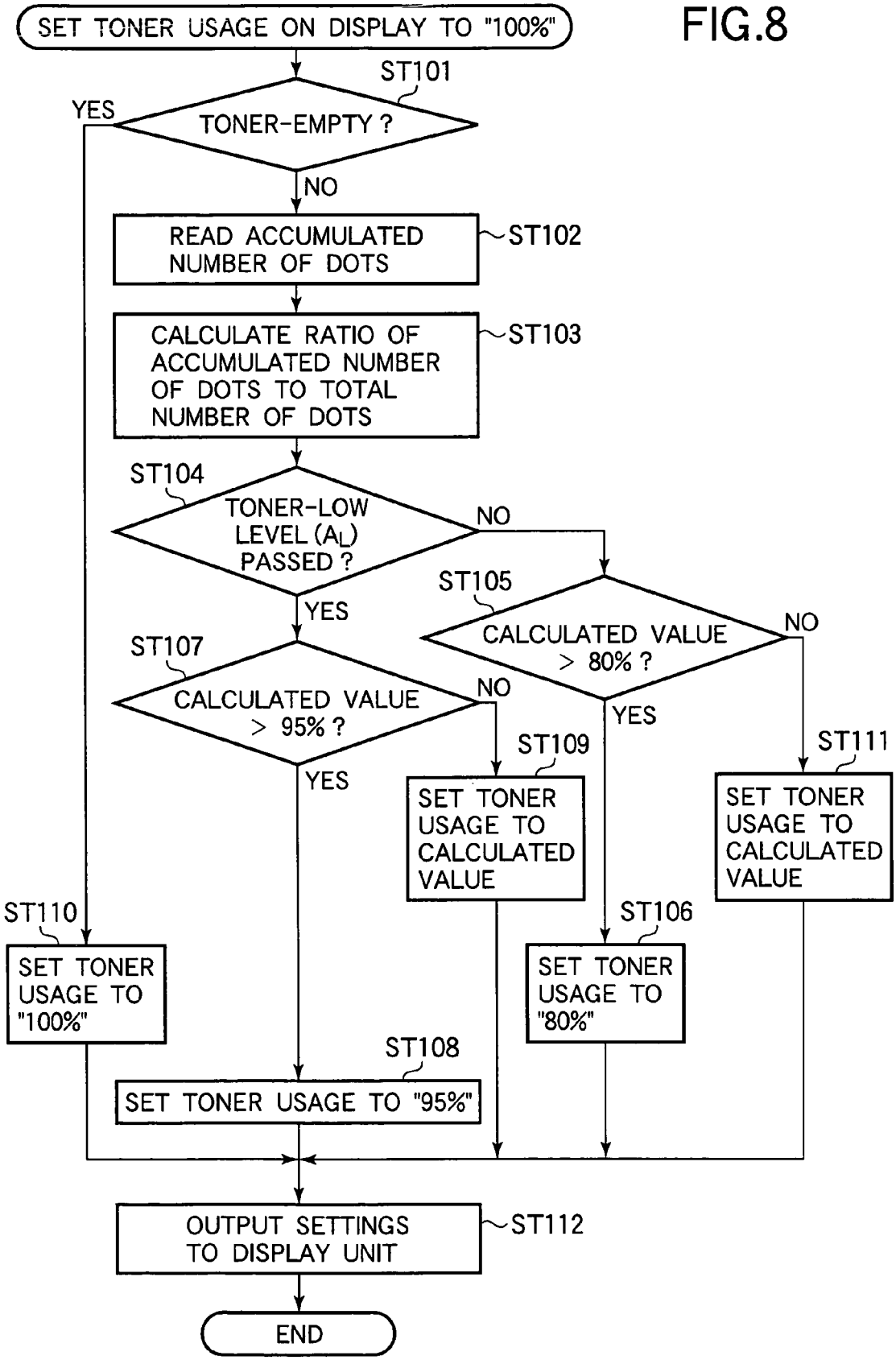
FIG.8
SET TONER USAGE ON DISPLAY TO "100%"
ST101
TONER-EMPTY ?
YES
NO
READ ACCUMULATED NUMBER OF DOTS
ST102
CALCULATE RATIO OF ACCUMULATED NUMBER OF DOTS TO TOTAL NUMBER OF DOTS
ST103
ST104
TONER-LOW LEVEL ($A_L$) PASSED ?
NO
YES
ST105
CALCULATED VALUE > 80% ?
NO
YES
ST107
CALCULATED VALUE > 95% ?
NO
YES
ST109
SET TONER USAGE TO CALCULATED VALUE
ST111
SET TONER USAGE TO CALCULATED VALUE
ST110
SET TONER USAGE TO "100%"
ST106
SET TONER USAGE TO "80%"
ST108
SET TONER USAGE TO "95%"
OUTPUT SETTINGS TO DISPLAY UNIT
ST112
END

IMAGE FORMING APPARATUS

BACKGROUND OF THE INVENTION

1. Field of the Invention

The present invention relates to an image forming apparatus such as electrophotographic printers, and more particularly to an image forming apparatus having a function of displaying consumable usage.

2. Description of the Related Art

Usage of consumables in an image forming apparatus may be determined in a variety of ways and displayed on a display of the apparatus. For example, a remaining amount of toner in a toner cartridge can be estimated based on an accumulated number of dots that have been printed, an amount of toner consumed for printing each dot, and an initial amount of toner held in the toner cartridge. Some conventional apparatuses are capable of detecting when an amount of remaining toner decreases below a predetermined level.

The amount of toner consumed in printing varies depending on the printing duty and types of images. This implies that the amount of toner consumed varies from dot to dot, and therefore the estimated remaining amount of toner may differ from an actual remaining amount of toner. For example, when a considerable amount of toner remains in the toner cartridge, a message "toner is empty" may be displayed, or when the toner cartridge is empty of toner, a message "considerable amount of toner exists" may be displayed. Moreover, for color printers, the toner usage is different depending on the color.

SUMMARY OF THE INVENTION

An object of the invention is to solve the aforementioned drawbacks.

An object of the invention to provide an image forming apparatus in which a remaining toner is displayed without making users confused with impractical display.

An image forming apparatus includes a developer reservoir, a detector, a computing section, a display unit, and a controller. The developer reservoir holds developer therein. The detector detects when the developer decreases to a first amount. The computing section computes current accumulated developer usage. The current accumulated developer usage is displayed on the display unit. The controller controls the display unit to display the current accumulated developer usage. When the detector detects the first amount, the controller controls the display unit to display a first value of the current accumulated developer usage that has been consumed until the first amount is detected.

The computing section includes a counting section and a storing section. The counting section counts a current accumulated number of printed dots when an image is formed. The storing section stores the current accumulated number of printed dots. When the detector detects the first amount, the controller stores the current accumulated number of printed dots into the storing section, the current accumulated number of printed dots corresponding to the toner usage that has been consumed until the first amount is detected.

When the current accumulated developer usage reaches to a second value smaller than the first value, the controller controls the display unit to continue to display the second value until the first amount is detected.

When the current accumulated developer usage reaches to a third value larger than the first value, the controller controls the display unit to display the third value until the current accumulated developer usage reaches a fourth value larger than the third value. When the current accumulated developer usage exceeds the fourth value, the controller controls the display unit to display information representing that the developer reservoir is empty of the developer.

An image forming apparatus includes a plurality of detectors, a computing section, a display unit, and a controller. Each the plurality of detectors detects when developer held in a corresponding one of a plurality of developer reservoirs decreases to a first amount. The computing section computes current accumulated developer usage of developer held in each one of the plurality of developer reservoirs. The display unit displays the current accumulated developer usage computed by the computing section. The controller controls the display unit to display the current accumulated usage of developer held in each one of the plurality of developer reservoirs. When each one of the plurality of detectors detects the first amount, the controller controls the display unit to display the current accumulated developer usage for a corresponding one of the plurality of developer reservoir, the current accumulated developer usage corresponding to an amount of developer has been consumed until the first amount is detected.

The computing section includes a counting section and a storing section. The counting section counts a current accumulated number of printed dots when an image is formed using the developer in a corresponding one the plurality of developer reservoirs. The storing section stores the current accumulated number of printed dots counted by the counting section. When the detector detects the first amount, the controller stores the current accumulated number of printed dots into the storing section. The current accumulated number of dots corresponds to an amount of developer has been consumed until the first amount is detected.

The plurality of developer reservoirs hold toners of different colors.

One of the plurality of developer reservoirs holds a larger amount of developer of a corresponding color than the others of the plurality of developer reservoirs.

The plurality of developer reservoirs hold black toner, yellow toner, magenta toner, and cyan toner, respectively.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 8 illustrates the procedure for updating the toner usage on display;

DETAILED DESCRIPTION OF THE INVENTION

First Embodiment

{Construction}

Figure 1:
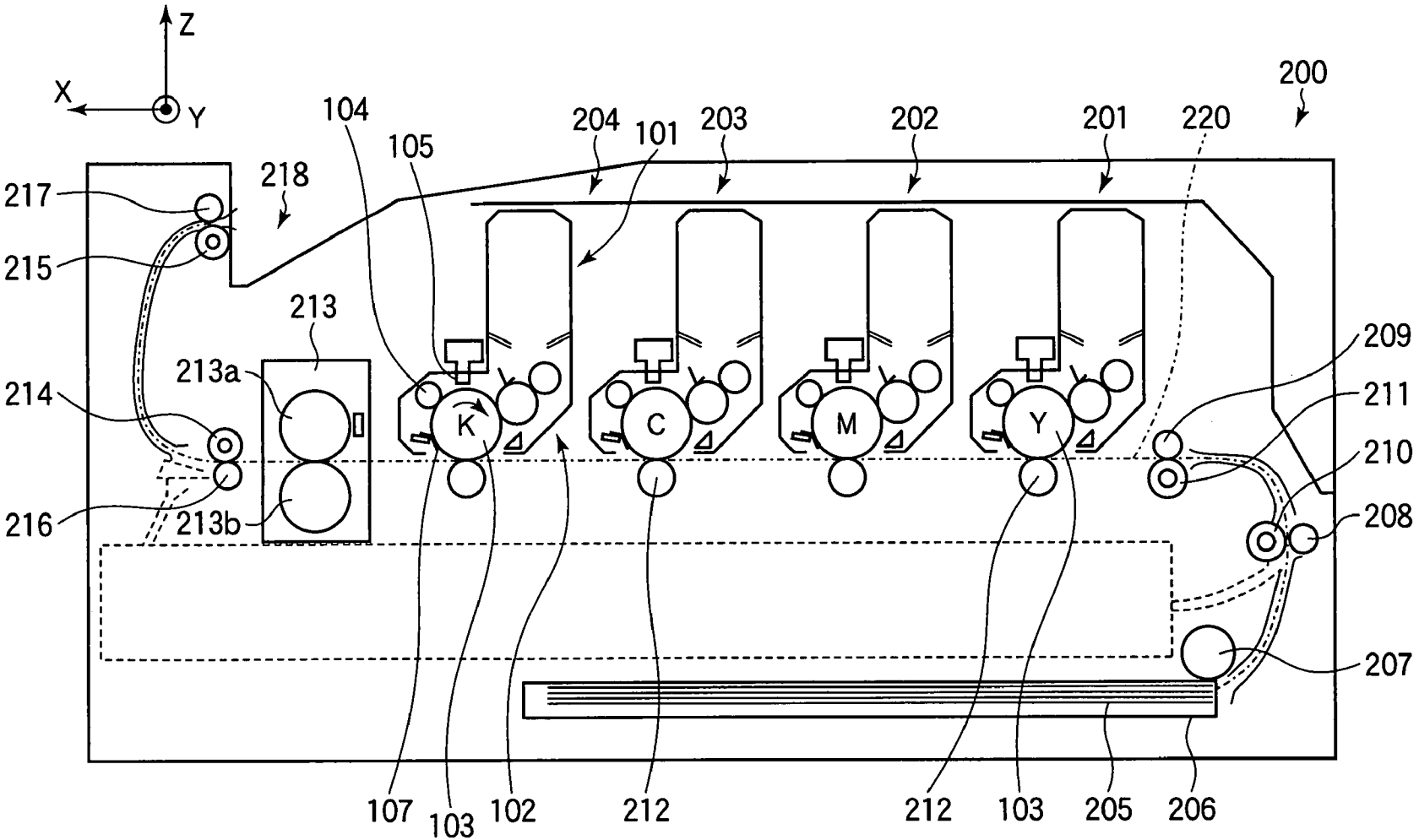
FIG. 1 is a side view illustrating the overall configuration of an image forming apparatus.

FIG. 1 is a side view illustrating the overall configuration of an image forming apparatus 200.

Figure 2A:
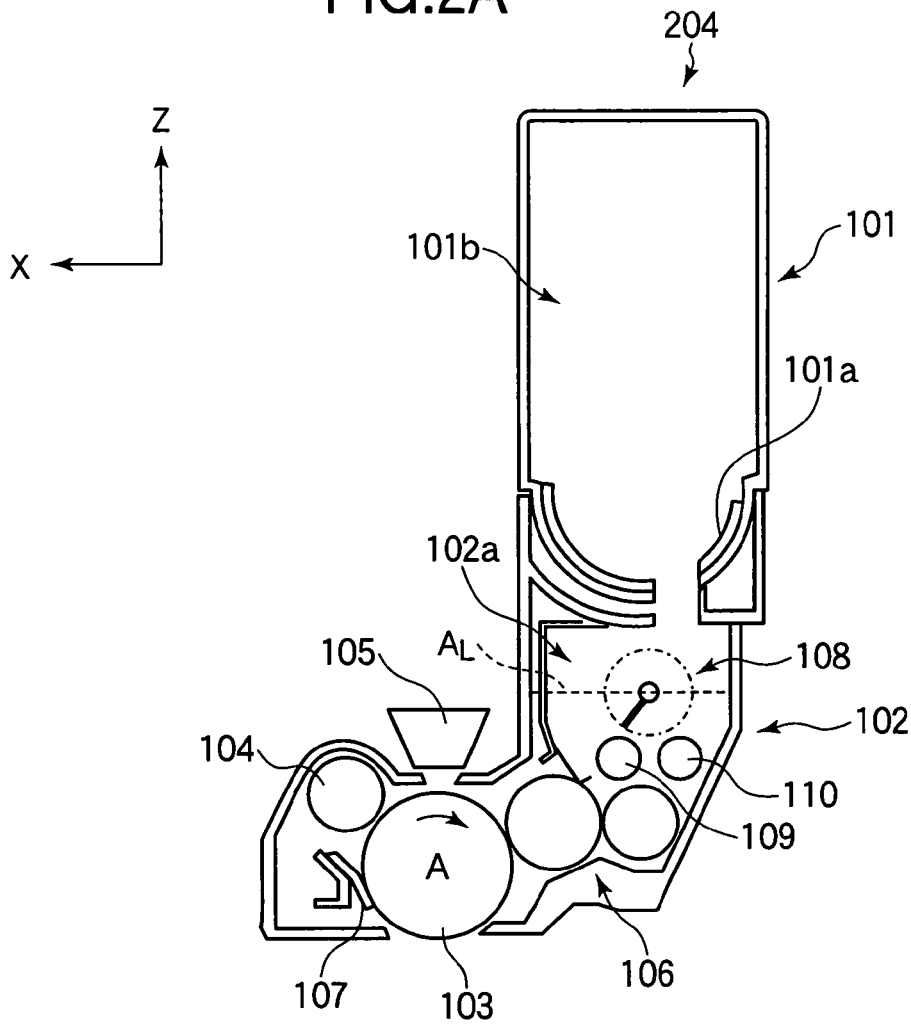
FIG. 2A is a cross sectional view illustrating the configuration of a process unit.
Figure 2B:
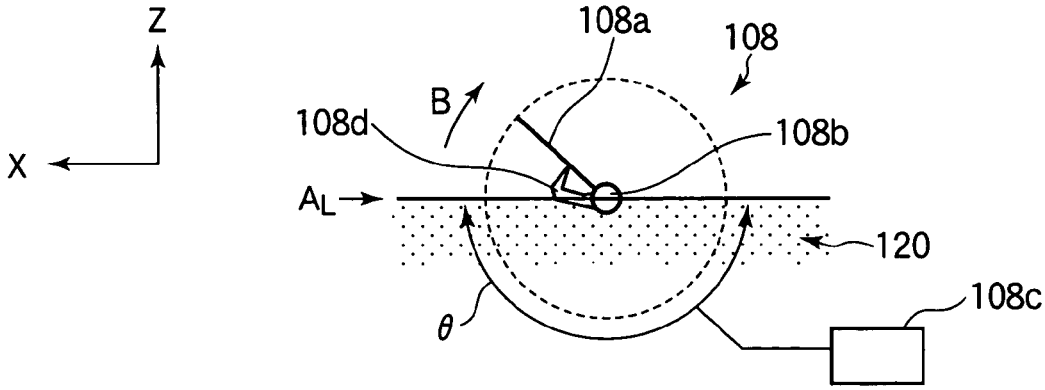
FIG. 2B illustrates the operation for the toner-low sensor to detect a toner-low level.

In FIGS. 1, 2A and 2B, an X-coordinate indicates a direction in which the recording medium 205 advances, a Y-coordinate indicates a direction of an axis about which the photoconductive drum 103 rotates, and a Z-coordinate indicates a direction perpendicular to the X- and Y-coordinates.

Referring to FIG. 1, the image forming apparatus 200 takes the form of an electrophotographic printer, and includes four process units 201-204 that form yellow, magenta, cyan, and black images, respectively. The process units 201-204 are aligned in this order along a transport path 220 of a recording medium 205 from upstream to downstream. For simplicity, only the operation of the process unit 204 for black will be described, it being understood that the other cartridges 20 may work in a similar fashion.

A paper cassette 206 is attached to a lower portion of the image forming apparatus 200, and holds a stack of the recording medium 205 such as paper. A hopping roller 207 is disposed over the paper cassette 206 for feeding the recording medium 205 into the transport path 220 on a page-by-page basis. A pinch roller 208 and a feed roller 210 are disposed downstream of the hopping roller 207. The pinch roller 208 and the feed roller 210 rotate while holding a page of the recording medium 205 in sandwiched relation, thereby advancing the page of recording medium 205. A pinch roller 209 and a registration roller 211 are disposed downstream of the pinch roller 208 and the feed roller 210, remove skew of the recording medium 205, and feed the recording medium 205 into the process unit 201. The hopping roller 207, transport roller 210, and registration roller 211 are driven in rotation by a driving force transmitted via gears from a mechanical power source, not shown.

Transfer rollers 212 are formed of an electrically conductive rubber material, and are disposed to oppose the photoconductive drums 103 of the respective process units 201-204. When the toner image is transferred from the photoconductive drum onto the recording medium 205, a voltage is applied to the transfer roller 212 such that a potential difference is developed between the surface of the photoconductive drum 103 and the surface of the transfer roller 212.

A fixing unit 213 includes a heat roller 213*a* and a backup roller 213*b* in pressure contact with the heat roller 213*a* to define a fixing point between the heat roller 213*a* and the backup roller 213*b*. When the recording medium 205 passes the fixing point, the toner image on the recording medium 205 is fused into a permanent image due to pressure and heat. A discharge roller 214 and a pinch roller 216 hold the recording medium 205 between them in sandwiched relation, and rotate to advance the recording medium 205 into a discharge path after fixing. A discharge roller 215 and a pinch roller also hold the recording medium 205 between them in sandwiched relation, and rotate to discharge the recording medium 205 onto a stacker 218. The heat roller 213*a*, backup roller 213*b*, pinch rollers 216 and 217, and discharge rollers 214 and 215 are driven in rotation by a driving force transmitted via gears from a mechanical power source, not shown.

FIG. 2A is a cross sectional view illustrating the configuration of a process unit 204. Referring to FIG. 2A, the process unit 204 includes a toner cartridge 101 and an image drum unit 102. The toner cartridge 101 includes a toner chamber 101*b* that holds toner in it, and is detachably attached to the image drum unit 102. The toner cartridge 101 includes a lid 101*a* that operatively opens when the toner cartridge 101 is attached to the image drum unit 102.

A photoconductive drum 103 is arranged such that the photoconductive drum is rotatable in a direction shown by arrow A. Disposed around the photoconductive drum 103 are a charging roller 104, an exposing unit 105, a developing unit 106, and a cleaning blade 107. The charging roller 104 charges the surface of the photoconductive drum 103. The exposing unit 105 selectively illuminates the charged surface of the photoconductive drum 103 to form an electrostatic latent image. The developing unit 106 supplies toner to the electrostatic latent image to develop the electrostatic latent image into a toner image. The cleaning blade 107 removes residual toner from the surface of the photoconductive drum 103 after transferring the toner image onto the recording medium 205.

The image drum unit 102 further includes a toner reservoir 102*a* that receives the toner from the toner cartridge 101 when the lid 101*a* opens. The toner reservoir 102 accommodates a toner-low sensor 108 and agitator screws 109 and 110 therein. These structural elements are driven in rotation by a driving force transmitted via gears from a mechanical power source, not shown.

Figure 2C:
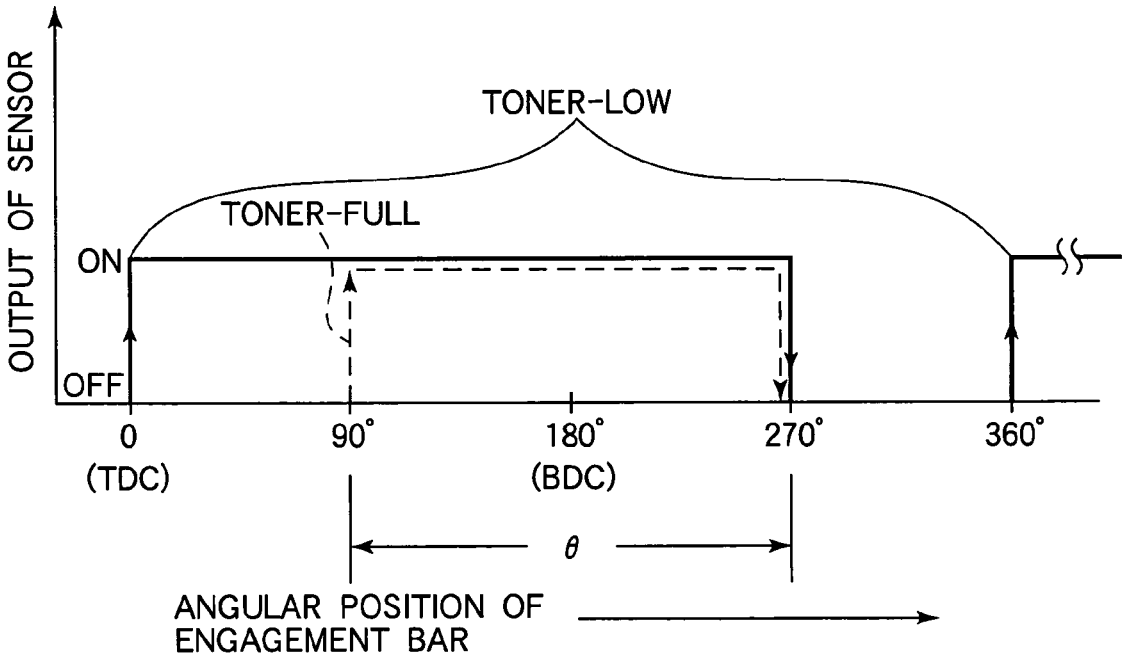
FIG. 2C illustrates the operation of a toner-low sensor.

FIG. 2C illustrates the operation of the toner-low sensor 108.

FIG. 2C plots the output of the toner-low sensor 108 as the ordinate and the angular position of an engagement bar 108*d* (FIG. 2B) as the abscissa. Referring to FIG. 2C, top dead center (TDC) is the angular position of the sensor bar 108*a* when the sensor bar 108*a* is vertically upward in FIG. 2B, and bottom dead center (BDC) is the angular position of the sensor bar 108*a* when the sensor bar 108 is vertically downward in FIG. 2B.

When the toner reservoir 102*a* is full of toner, the engagement bar 108*d* rotates together with the sensor bar 108*a* so that the output of the toner low-sensor goes high at a 90° angular position of the sensor bar 108*a* and goes low at a 270° angular position. When the toner in the toner reservoir 102*a* reaches a toner low level $A_L$, the output of the toner low-sensor goes high as soon as the sensor bar 108*a* rotates past the top dead center (TDC) at a 0° angular position of the sensor bar 108*a*. Then, the output goes low at 270°. Thus, the duration of the output of the toner-low sensor 108 remains high varies depending on the remaining amount of the toner in the toner reservoir 102*a*. When the toner in the toner reservoir 102*a* reaches the toner low level $A_L$, the duration of the output of a high level is longest. In this manner, the toner-low level $A_L$ can be detected.

Figure 3:
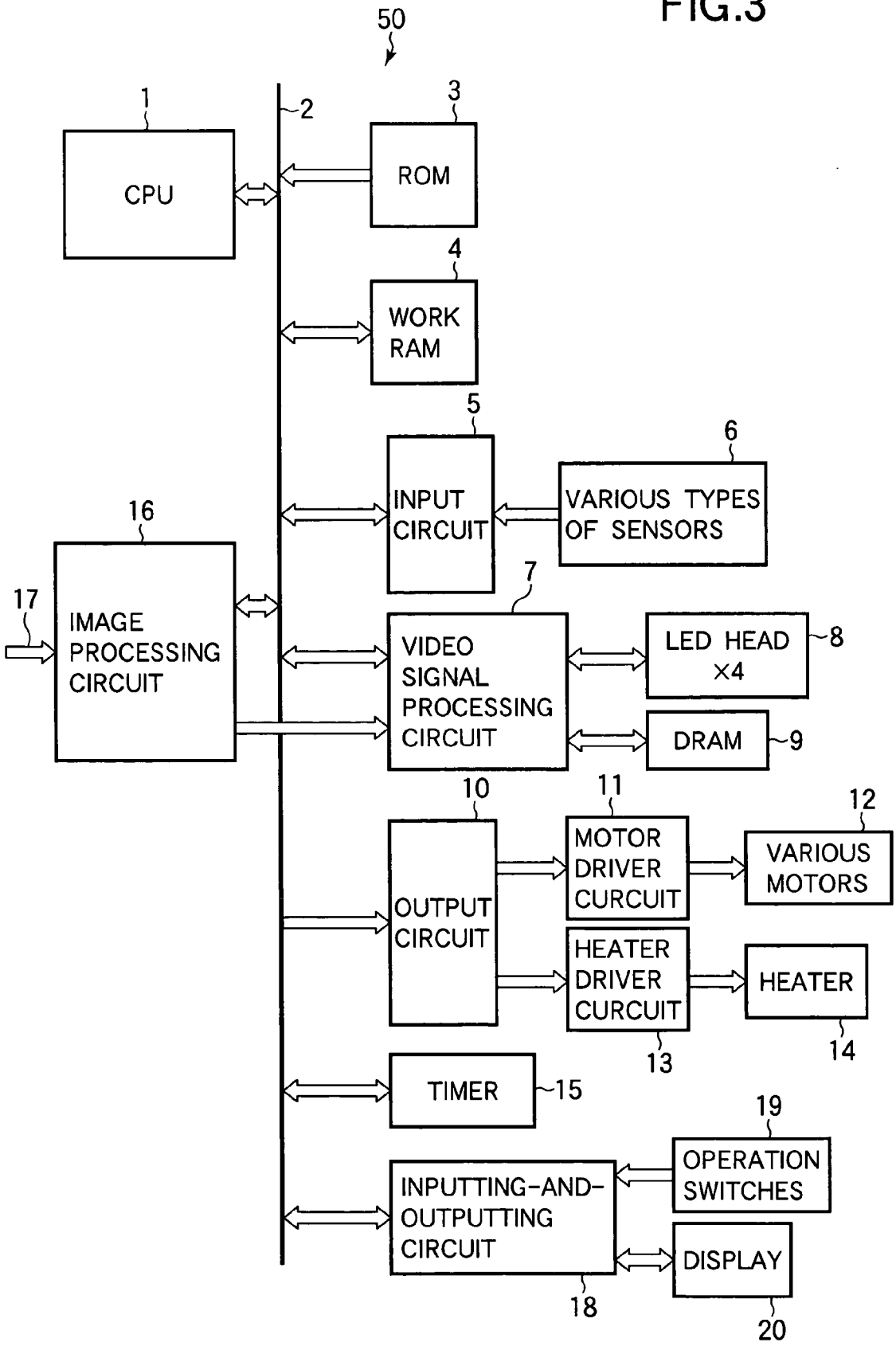
FIG. 3 is a block diagram illustrating the configuration of a control system for the image forming apparatus.

FIG. 3 is a block diagram illustrating the configuration of a control system for the image forming apparatus 200. A CPU 1 is connected to other circuits via a CPU bus 2, and controls the operations and processing of the image forming apparatus 200. The CPU 1 executes control programs stored in a ROM 3 to perform various processing.

When the CPU 1 executes the control programs, a RAM 4 temporarily holds various variables and items of data. An input circuit 5 is connected to various types of sensors 6 including paper-detecting sensors, not shown, and the toner low sensor 108 (FIGS. 2A and 2B).

An image processing circuit 16 receives image data from a host apparatus, not shown, via an interface 17, and sends the received image data to a video signal processing circuit 7. The video signal processing circuit 7 stores the received image data into a DRAM 9, and then reads the image data from the DRAM 9 at a print timing generated by the CPU 1. The image data is sent to LED heads 8 for the respective colors. The LED heads 8 are mounted to the exposing units 105 provided to the respective process units 201-204, and illuminate the surfaces of corresponding photoconductive drums 103 to form electrostatic latent images. The video signal processing circuit 7 also counts the number of dots printed.

An output circuit 10 is connected to a motor driver circuit 11 which in turn is connected to various motors 12 including motors and actuators for clutches used for the respective mechanisms. In accordance with the instructions from the CPU 1, the motor-driver circuit 11 operates, for example, to transport the recording medium 205. The output circuit 10 is also connected to a heater-driver circuit 13 and a heater 14, and controls the temperature of the heat roller 213*a* of the fixing unit 213.

A timer circuit 15 incorporates a plurality of timers that measure the print timing and actuating timing for the various actuators, and the CPU 1 executes various processing at these timings. An input-and-output circuit 18 is connected to operation switches 19 and a display 20, by which various settings for the image forming apparatus 200 can be performed. The display 20 also displays the current statuses of the image forming apparatus 200.

{Printing Operation}

The printing operation of the image forming apparatus 200 of the aforementioned configuration will be described.

Referring to FIG. 1, the hopping roller 207 feeds the top page of the stack of the recording medium 205 from the paper cassette 206 into the transport path 220. The pinch roller 208 and the feed roller 210 rotate to advance the page of the recording medium 205 through the transport path 220, while holding the page of the recording medium 205 in sandwiched relation between the pinch roller 208 and the feed roller 210. The pinch roller 209 and the registration roller 211 rotate to advance the page of the recording medium 205 in timed relation with the image formation of the process unit 201. As the page of the recording medium 205 advances through a transfer point defined between the photoconductive drum 103 and the transfer roller 212, the toner image is transferred onto the page of the recording medium 205.

As the page of the recording medium 205 passes through the process units 202-204 in sequence, toner images of the respective colors are transferred one over the other in registration. Then, the recording medium 205 enters the fixing unit 213 where the toner image is fixed into a full color permanent image. Then, the recording medium 205 is discharged by the discharge rollers 214 and 215 and the pinch rollers 216 and 217 onto the stacker 218.

{Displaying Toner Usage}

The display of toner usage will be described.

The CPU 1 receives the rotation timings of the toner-low sensor 108 via the input circuit 5, thereby detecting whether the remaining toner held in the image drum unit 102 is below a threshold level, i.e., the toner-low level $A_L$ indicated in a dotted line in FIG. 2A and in a solid line in FIG. 2B.

FIG. 2B illustrates the operation for the toner-low sensor 108 to detect the toner-low level $A_L$. The sensor bar 108*a* is mounted on a rotating shaft 108*b* of a driving means for driving the rotating shaft 108*b*, not shown, and is rotatable relative to the rotating shaft 108*b*. The rotating shaft 108*b* rotates at a constant speed. An engagement bar 108*d* is secured to the rotating shaft 108*b*, and rotates together with the rotating shaft 108*b*.

When the toner reservoir 102*a* of the image drum unit 102 is full of the toner, the engagement bar 108*d* pushes the sensor bar 108*a* such that the engagement bar 108*d* and the sensor bar 108*a* rotate together at all times.

When the remaining amount of toner in toner reservoir 102*a* is at a toner-low level $A_L$, the engagement bar 108*d* rotate in a direction shown by arrow B to engage the sensor bar 108*a* and push up the sensor bar 108*a* until the sensor bar passes its top dead center (TDC). When the sensor bar 108*a* rotates past its top dead center, the sensor bar 108*a* falls onto the surface of the toner due to its weight. When the sensor bar 108*a* is within an angular range shown by θ, the engagement bar 108*d* pushes the sensor bar 108*a* against the toner and a sensor 108*c* detects the sensor bar 108*a*. The sensor 108*c* provides a detection signal (ON) to the input circuit 5.

As long as the sensor bar 108*a* moves in the toner, the sensor bar 108*a* is pushed by the engagement bar 108*d* and rotates together with the engagement bar 108*d* at a constant speed while agitating the toner. In this manner, the detection signal of the sensor 108*c* cycles ON and OFF periodically.

When the remaining toner is at the toner-low level $A_L$, the ON period of the detection signal of the sensor 108*c* is longer when the toner reservoir 102*a* is full of toner than when the remaining toner is at the toner-low level $A_L$. The CPU 1 monitors the duty ratio of the detection signal to determine when the remaining toner reaches the toner-low level $A_L$.

A description will be given of how the toner usage is displayed to the user. The description will be given with reference to FIGS. 4, 5, 9, and 10.

Figure 4:
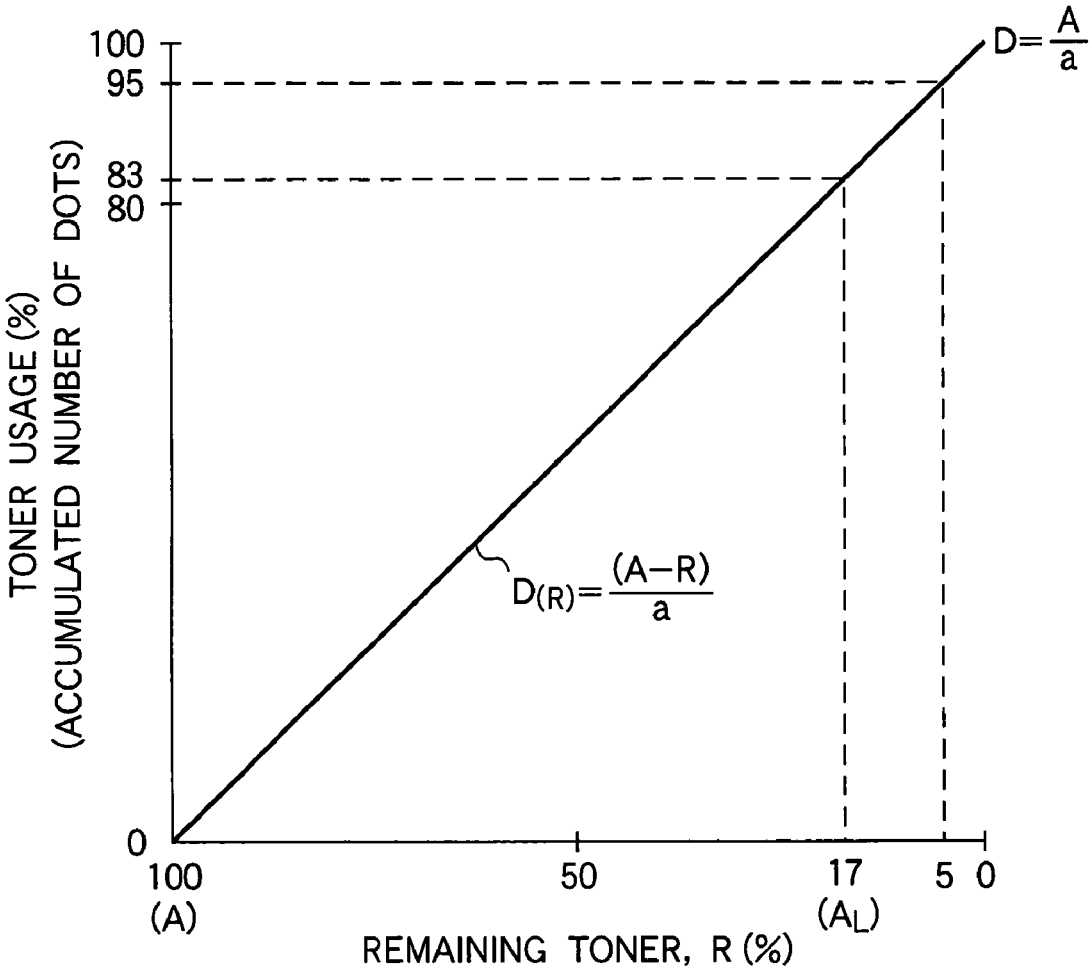
FIG. 4 illustrates the relation between the amount of remaining toner and the toner usage or accumulated number of dots.

FIG. 4 plots the amount of remaining toner as the abscissa and the toner usage or accumulated number of dots as the ordinate. The accumulated number of dots is the number of dots that are actually printed after a new, unused toner cartridge is attached to the image drum unit 102.

The amount of toner held in a toner cartridge 101 is commonly expressed in terms of the number of pages of A4 size paper, provided that images are printed at a print duty of 5%.

Assume that "a" is an amount of toner consumed for printing one dot at a print duty of 5%, and that "A" is an initial amount of toner in a new, unused toner cartridge. Thus, a total number of dots D that can be printed using the amount of toner A is given by D=A/a. The relation between the remaining toner R in percentage and the accumulated number of dots in percentage at any given time is obtained from a line D(R)=(A-R)/a.

The CPU 1 calculates the accumulated number of dots D(R), and controls the display unit 20 to display the D(R) as a current toner usage to the user. In the present invention, the toner-low level $A_L$ in FIG. 2B is such that the remaining toner in the toner reservoir 102*a* is 17% of the initial amount of toner A. Thus, the amount of toner consumed from when the new, unused toner cartridge is attached to the apparatus until the toner-low level $A_L$ is detected is 83% of the initial amount of toner A.

Figure 5:
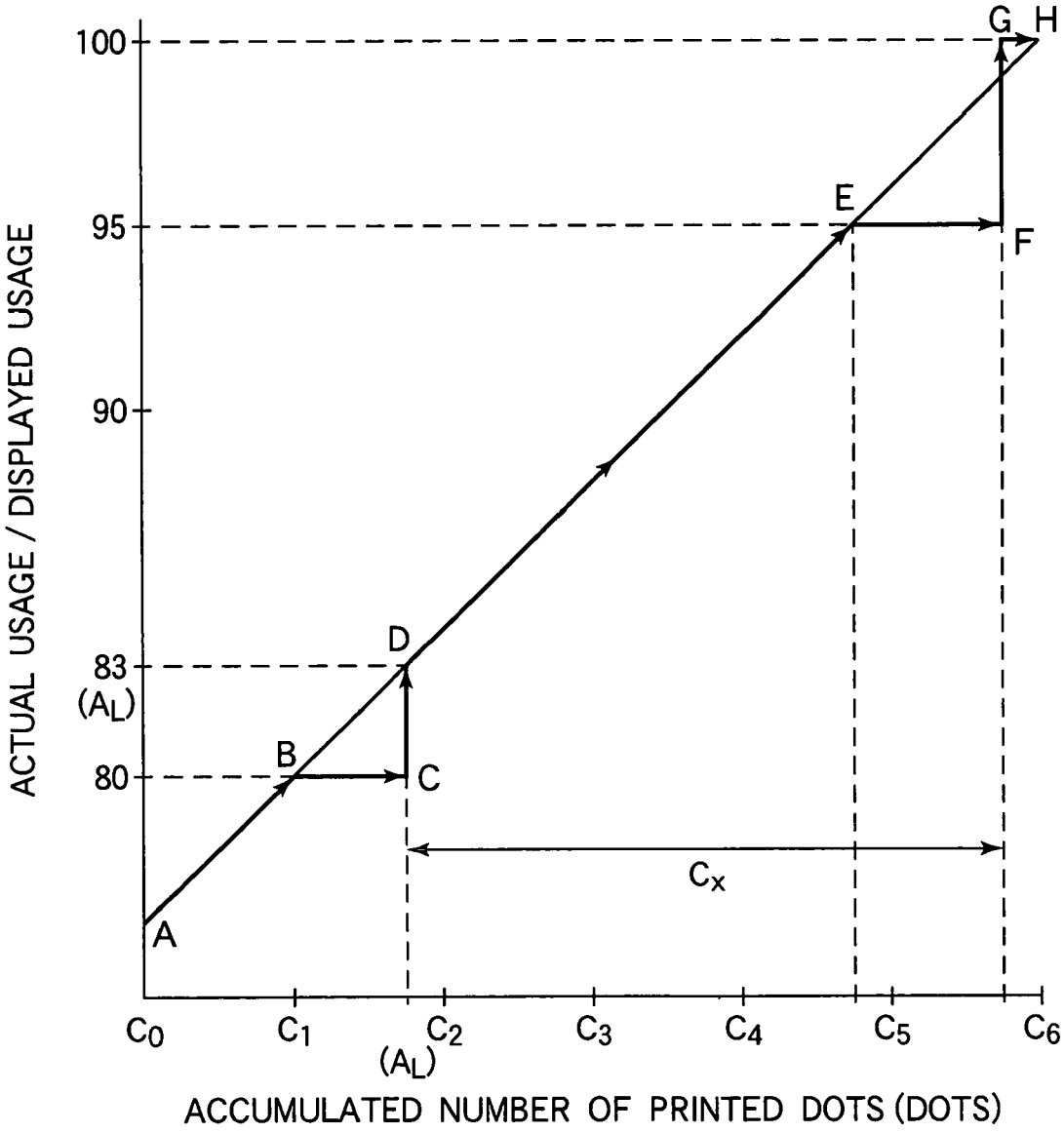
FIG. 5 shows the relationship between the remaining toner and the toner usage on display when printing is performed at a print duty of 5%.

With reference to FIG. 5, a description will be given of the display of the usage of black toner held in the toner cartridge 101 attached to the process unit 204.

FIG. 5 shows the relationship between the accumulated number of printed dots and the toner usage on display and the relationship between the accumulated number of printed dots and actual toner usage when printing is performed at a print duty of 5% after a new, unused toner cartridge 101 is attached. The actual toner usage follows points A, B, D, E, and H. The toner usage on display follows points A, B, C, D, E, F, and G. The CPU 1 continually updates the toner usage on display from point A to point B and from point D to point E. At point B at which the amount of consumed toner is, for example, "80%", the CPU 1 halts updating the toner usage on the display unit 20, so that the toner usage on display remains "80%".

When the toner-low sensor 108 detects that the remaining toner R in the toner reservoir 102*a* has reached the toner-low level $A_L$ at point C, the CPU 1 switches the toner usage on display from "80%" to "83%". Then, the CPU 1 resumes updating the toner usage on display.

At point E at which the amount of toner consumed reaches, for example, "95%", the CPU 1 halts updating the toner usage displayed on the display unit 20, so that the toner usage on display remains "95%". Thereafter, when the current accumulated number of dots exceeds an accumulated number of dots corresponding to the toner usage at which the toner-low level $A_L$ is detected, by a predetermined reference value Cx, the CPU 1 determines that the toner in the toner reservoir 102*a* has been exhausted (i.e. "toner-empty"), and switches the toner usage on display from "95%" to "100%" at point D.

{Calculation of Accumulated Number of Dots}

Figure 6:
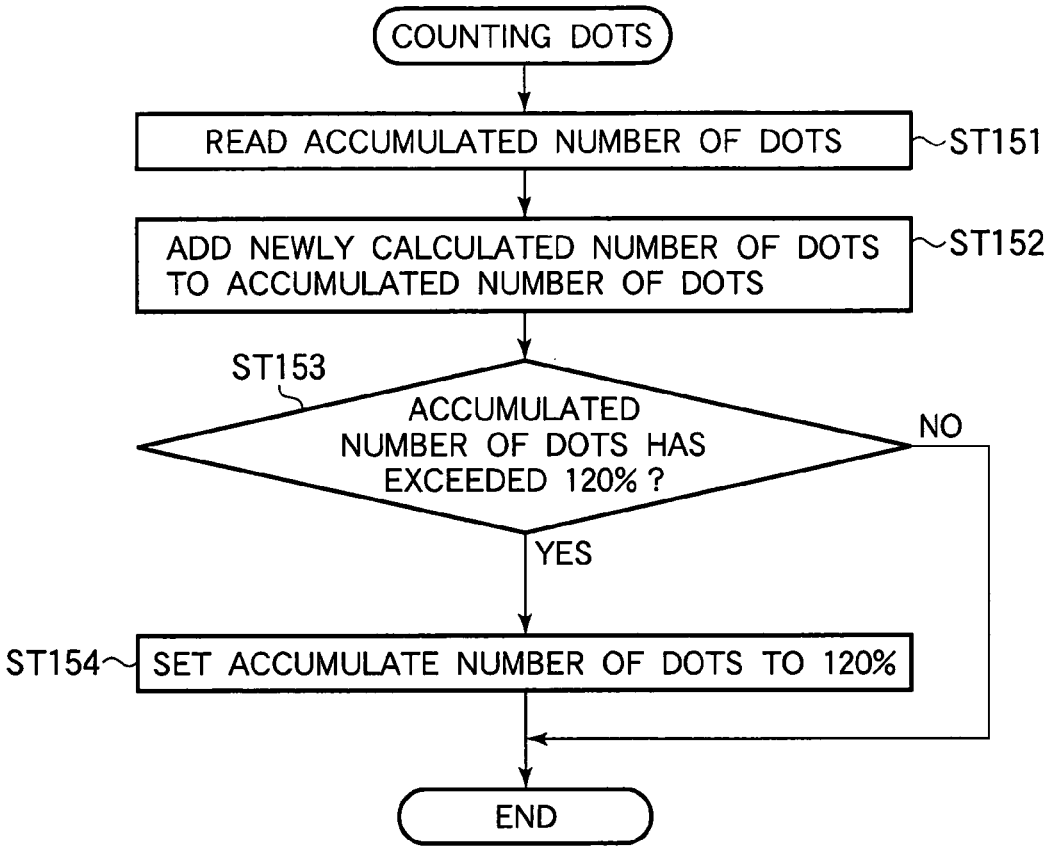
FIG. 6 illustrates the process for a CPU to count the accumulated number of dots.

FIG. 6 illustrates the process for the CPU 1 to count the accumulated number of dots.

When a printing operation completes or a predetermined number of pages have been printed in a printing operation, the CPU 1 activates the flowchart in FIG. 6 for updating the accumulated number of dots. The CPU 1 reads the accumulated number of dots from the RAM 4 (step S151). Then, the CPU 1 adds the number of dots newly calculated in the video signal processing circuit 7 to the accumulated number of dots read from the RAM 4, and stores the sum as an updated accumulated number of dots into the RAM 4 (step S152).

A check is made to determine whether the accumulated number of dots has exceeded a predetermined value (e.g. 120%) (step S154). If the answer is YES, the CPU 1 sets the accumulated number of dots to the predetermined value, i.e., 120% (step S154). If the answer is No at step S154, the program ends.

{Setting Accumulated Number of Dots When Toner-Low Level is Detected}

Figure 7:
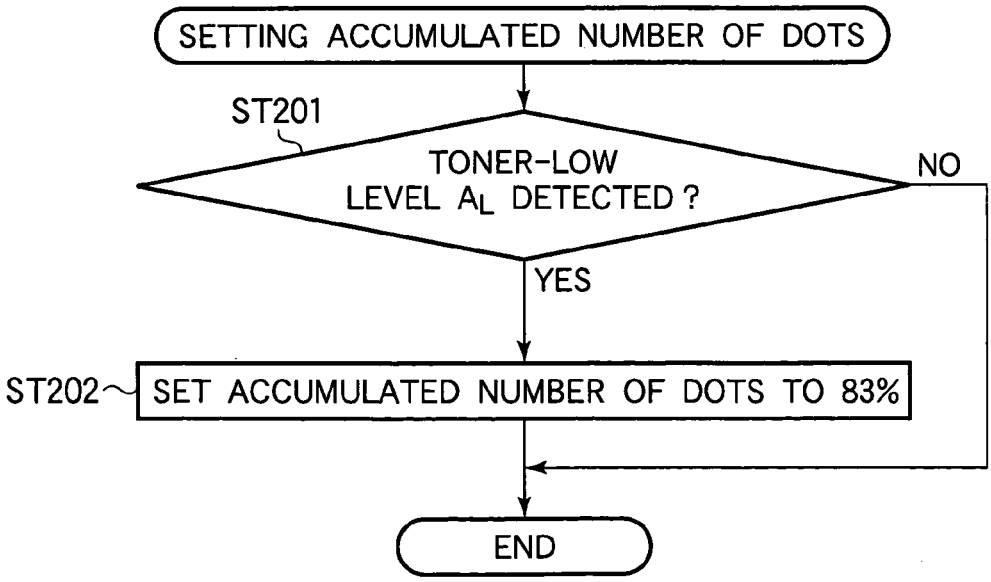
FIG. 7 illustrates a flowchart that describes the process for the CPU to set the accumulated number of dots to a predetermined value when the toner-low level $A_L$ is detected.

FIG. 7 illustrates a flowchart that describes the process for the CPU 1 to set the accumulated number of dots to a predetermined value (e.g., 83%) when the toner-low level $A_L$ is detected.

When the toner-low sensor 108 detects that the remaining toner in the toner reservoir 102*a* has reached the toner-low level $A_L$, the CPU 1 activates the flowchart in FIG. 7 in order to set the accumulated number of dots to the predetermined value, i.e., 83%. A check is made to determine whether the toner-low sensor 108 has detected the toner-low level $A_L$ (step S201). If the answer is YES, the CPU 1 updates the accumulated number of dots to a value (A/a)×0.83. If the answer at S201 is NO, the program ends.

{Updating Toner Usage on Display}

FIG. 8 illustrates the procedure for updating the toner usage on display. The procedures will be described with reference to FIG. 8 and FIG. 5.

When a printing operation completes or a predetermined number of pages have been printed in a printing operation, the CPU 1 activates the flowchart in FIG. 8 in order to update the toner usage on display. A check is made to determine whether the toner reservoir is at a "toner-empty" state (step S101). If the answer is YES, the CPU 1 sets the toner usage on display to a value "100%". Then, the CPU 1 outputs the value "100%" to the display 20 (step S112).

If the answer is NO at step S101, the CPU 1 reads the accumulated number of dots from the RAM 4 (step S102). Then, the CPU 1 calculates the ratio of the accumulated number of dots to the total number of dots in percentage (step S103). Then, a check is made to determine whether the toner in the toner reservoir 102*a* is at the toner-low level $A_L$ (step S104). If the answer is YES, then a check is made to determine whether the calculated ratio is more than 95% (step S107).

If the answer is YES at step S107, the CPU 1 sets the toner usage on display to "95%" (step S108). If the answer is NO at step S107, the CPU 1 simply sets the toner usage to the calculated value (step S109). The updated toner usage at this moment corresponds to a range between point B and point C in FIG. 5.

If the answer is NO at step 104, a check is made to determine whether the calculated ratio is more than 80% (step S105). If the answer is YES, the CPU sets the toner usage to "80%" (step S106).

If the answer is NO at step S105, the CPU 1 simply sets the toner usage to the calculated ratio (step S111). The ratio set at steps S108, 109, 106, and 111 are outputted to the display 20 (step S112).

{Printing at Random Print Duty}

The amount of toner held in a toner cartridge is commonly expressed in terms of the total number of pages of A4 size paper that can be printed, provided that images are printed at a 5% print duty for each color. FIG. 5 shows the relationship between the remaining toner in percentage and the toner usage on display in percentage when printing is performed at a 5% print duty after a new, unused toner cartridge 101 is attached to the image forming apparatus 200. However, it is to be noted that the image forming apparatus 200 normally operates in such a way that printing is performed at various print duties randomly.

Figure 9A:
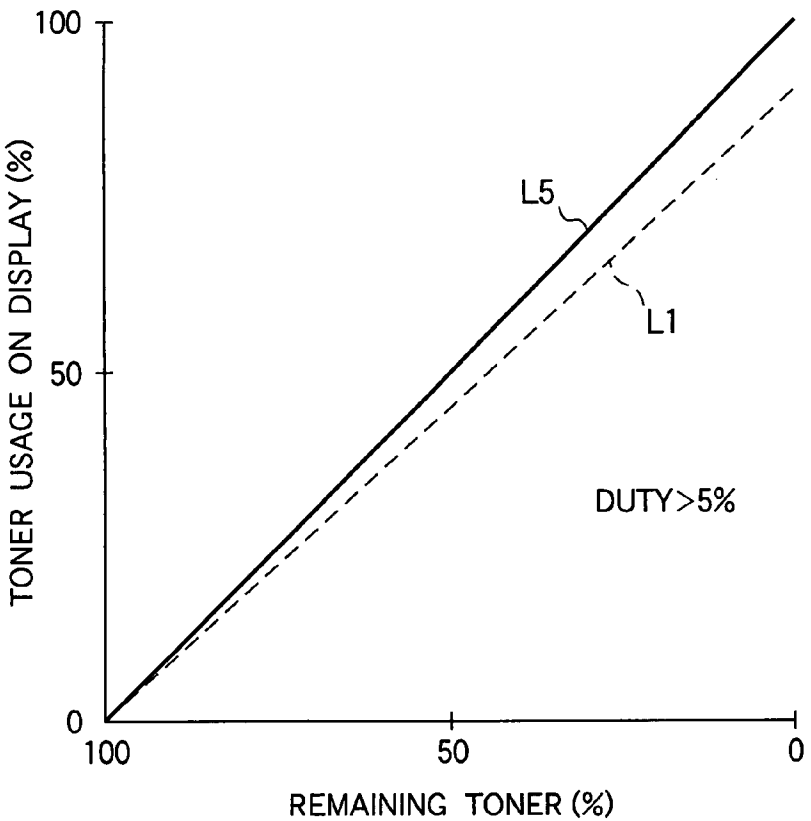
FIG. 9A illustrates a graph illustrating the toner usage on display for printing performed at a print duty greater than 5%.
Figure 9B:
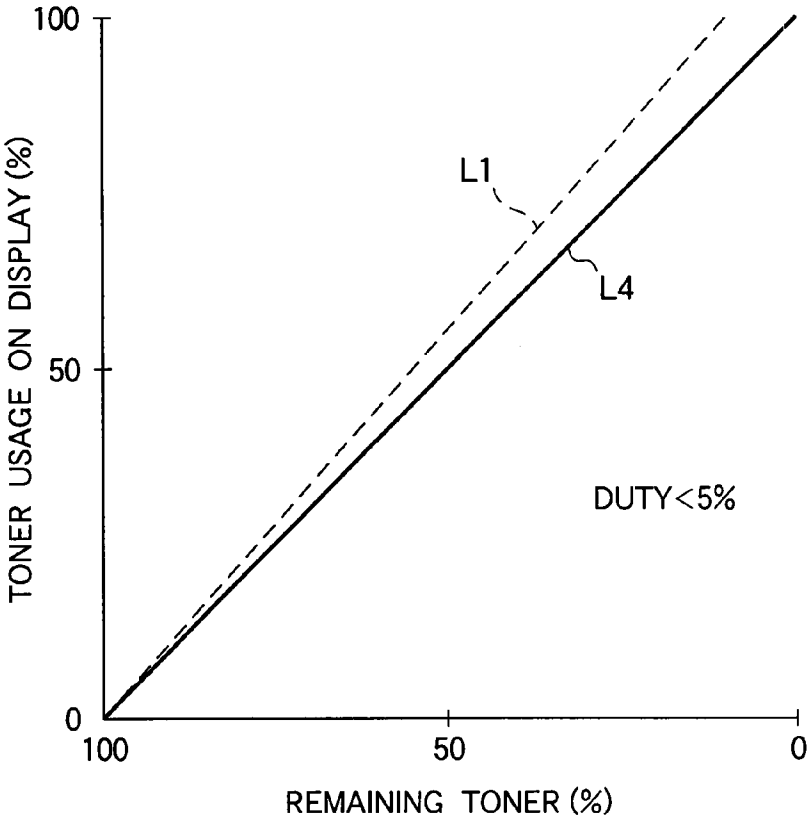
FIG. 9B illustrates a graph illustrating the toner usage on display when printing is performed at a print duty smaller than 5%.

FIGS. 9A and 9B show graphs illustrating the display if the aforementioned error correction is not performed.

FIG. 9A illustrates a graph illustrating the toner usage on display when printing is performed at a print duty greater than 5%. Line L1 (dotted line) represents the relationship between the remaining toner and the toner usage (or accumulated number of dots) on display when printing is performed at a print duty of 5%. Line L4 (solid line) represents the relationship between the remaining toner and the toner usage (or accumulated number of dots) on display when printing is performed at a print duty greater than 5%. Referring to FIG. 9A, the toner usage on display has an error that increases with increasing amount of toner consumed. For example, when the toner usage on display is "90%," the toner in the toner reservoir 102*a* has exhausted.

FIG. 9B illustrates a graph illustrating the toner usage on display when printing is performed at a print duty smaller than 5%. Line L1 (dotted line) represents the relationship between the remaining toner and the toner usage (or accumulated number of dots) on display when printing is performed at a print duty of 5%. Line L5 (solid line) represents the relationship between the remaining toner and the toner usage on display when printing is performed at a print duty smaller than 5%.

Referring to FIG. 9B, the toner usage on display has an error that increases with increasing amount of toner consumed. For example, when the toner usage on display is "100%," a considerable amount of toner is still left in the toner reservoir 102*a*.

{Toner Usage on Display at Print Duty Greater Than 5%}

Figure 10:
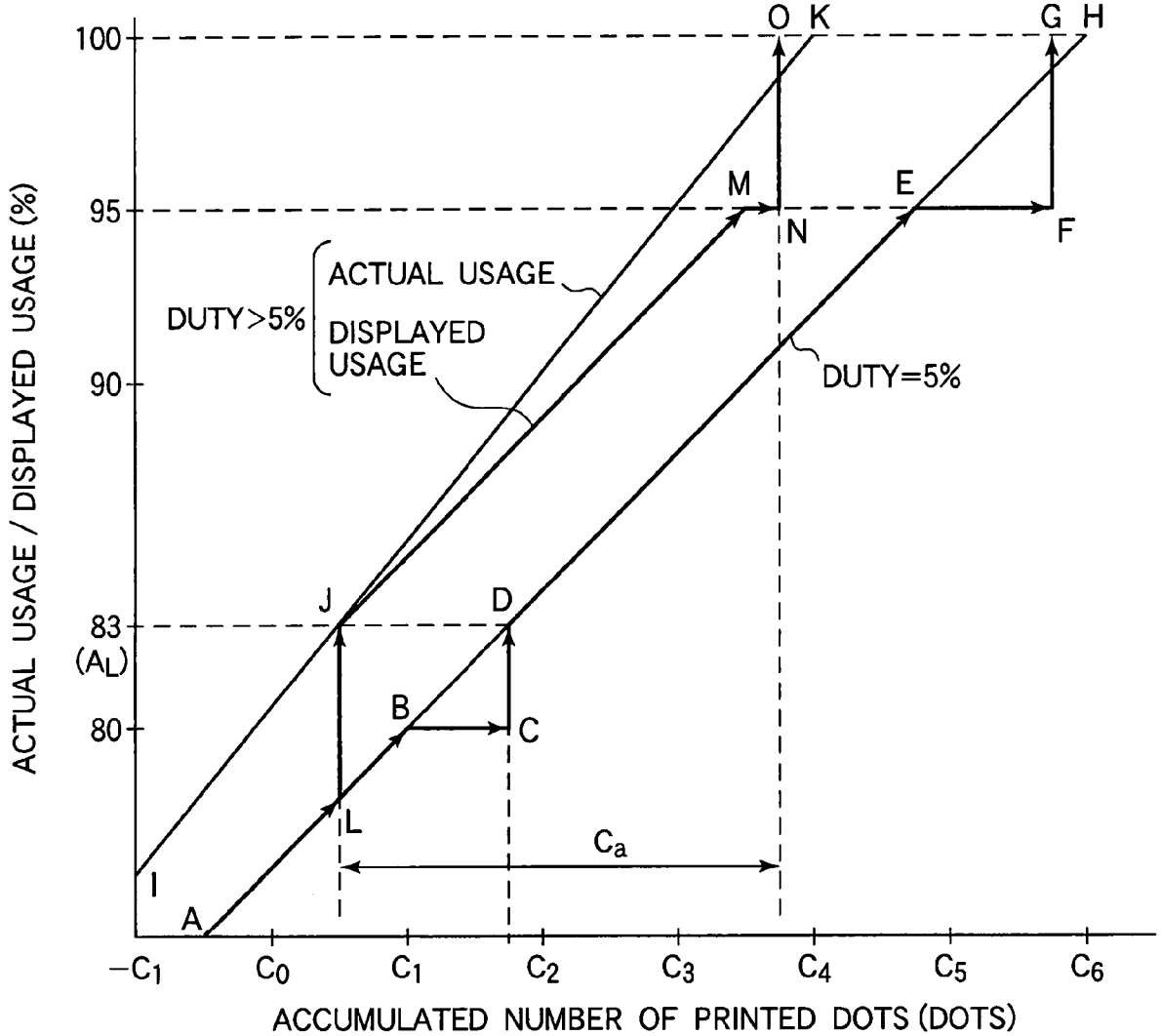
FIG. 10 shows a graph that illustrates the toner usage when printing is performed at a print duty greater than 5%.

FIG. 10 shows a graph that illustrates the relationship between toner usage and the number of printed dots for a print duty of 5% and a print duty greater than 5%. Referring to FIG. 10, when printing is performed at a print duty of 5%, the actual toner usage follows the line shown by points A, B, D, E, and H. The displayed toner usage is calculated as a function of the number of printed dots and follows the line shown by points A, B, C, D, E, F, and G.

When printing is performed at a print duty greater than 5%, the actual toner usage follows the line shown by points I, J, and K. When the toner-low level $A_L$ is detected, i.e., the actual toner usage reaches point J, the toner usage on display is 78% (point L), i.e., smaller than 83%. Thus, the CPU 1 forcibly sets the toner usage on display to 83% (point J). Thereafter, the CPU 1 continues to calculate the toner usage on display based on the additional number of printed dots, and updates the toner usage on display continually, so that the toner usage on display follows the line shown by points J and M. Because the calculation is made by using the same equation as for a print duty of 5%, the line J-M has the same slope as the line D-E. When the toner usage on display reaches 95% (point M), the CPU 1 halts updating the toner usage on display until a predetermined additional number of printed dots Ca is reached after the toner usage on display passed a value of 83%. When the predetermined additional number of printed dots Ca is reached at point N, the CPU 1 forcibly sets the toner usage on display to 100%. Alternatively, the CPU 1 may switch the toner usage on display from 95% to 100% a predetermined additional number of printed dots after the toner usage on display has reached 95%.

When printing is performed at a print duty greater than 5%, if the toner usage on display assumes that printing is being performed at a duty of 5%, then the toner usage on display follows the line shown by points A, B, C, D, E, F, and G, so that the toner usage on display excessively differs from the actual toner usage. However, because the toner usage on display is forcibly set to 83% when the actual toner usage reaches 83%, the difference between the actual toner usage and toner usage on display can be small after the toner usage on display is forcibly set to a value of 83%.

The operation will be described in more detail.

Because the amount of toner consumed for each dot is larger at a print duty above 5% than at a duty of 5%, the amount of toner actually consumed increases at a higher rate than the toner usage on display. Therefore, the toner-low level $A_L$ is actually detected at point J where the toner usage on display is 78%, less than 83%.

When the toner-low level $A_L$ is detected, the operation of step S109 of FIG. 8 is performed. That is, the CPU 1 sets the accumulated number of dots to a value (A/a)×0.83 corresponding to the actual toner usage at which the toner-low level $A_L$ is detected, and controls the display unit 20 to display "83%" such that the toner usage on display accurately reflects the actual toner usage.

When the toner usage on display reaches point M at which the toner usage is 95% (i.e., somewhat before "100%"), the CPU 1 halts updating the toner usage displayed on the display unit 20. In other words, the toner usage on display remains "95%" after point M. Then, printing is performed still further. When the current accumulated number of dots exceeds an accumulated number of dots that corresponds to the toner usage at which toner-low level $A_L$ is detected, by more than a predetermined value Ca, the CPU 1 determines that the toner has exhausted (i.e. "toner-empty"), and switches the toner usage on display from "95%" to "100%" at point N.

{Toner Usage on Display at Print Duty Less Than 5%}

Figure 11:
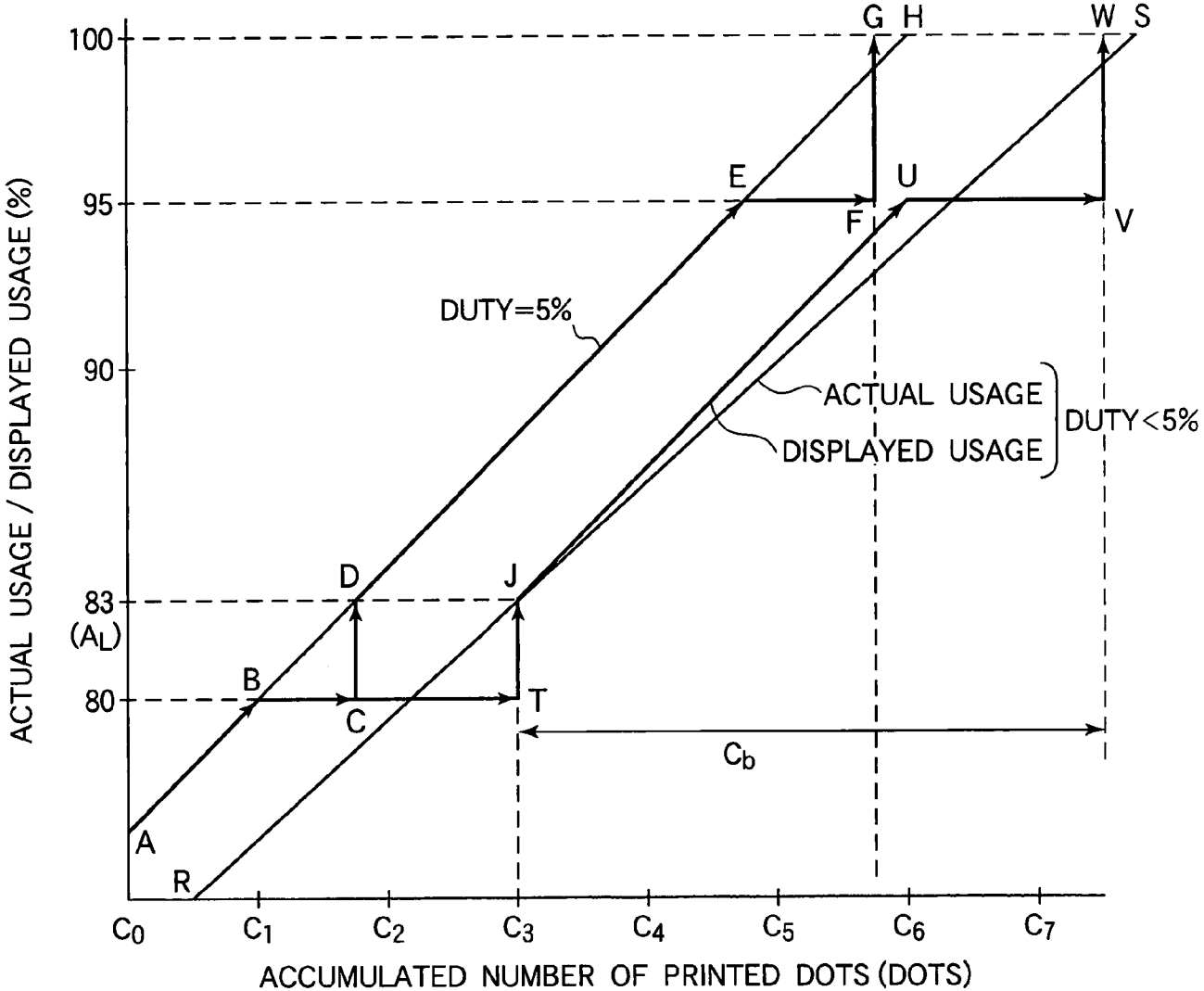
FIG. 11 shows a graph when printing is performed at a print duty smaller than 5%.

FIG. 11 shows a graph that illustrates the relationship between toner usage and the number of printed dots for a print duty of 5% and a print duty smaller than 5%. Referring to FIG. 11, when printing is performed at a print duty of 5%, the actual toner usage follows the line shown by points A, B, D, E, and H. The displayed toner usage is calculated as a function of the number of printed dots and follows the line shown by points A, B, C, D, E, F, and G.

When printing is performed at a print duty smaller than 5%, the actual toner usage follows the line shown by points R, J, and S. When the toner usage on display reaches 80% (point B), the CPU 1 halts updating the toner usage on display. When the toner-low level $A_L$ is detected, i.e., the actual toner usage reaches point J, the toner usage on display is still 80% (point T), i.e., smaller than 83%. Thus, the CPU 1 forcibly sets the toner usage on display to 83% (point J). Thereafter, the CPU 1 continues to calculate the toner usage on display based on the additional number of printed dots, and updates the toner usage on display continually, so that the toner usage on display follows the line shown by points J and U. Because the calculation is made by using the same equation as for a print duty of 5%, the line J-U has the same slope as the line D-E. When the toner usage on display reaches 95% (point U), the CPU 1 halts updating the toner usage on display until a predetermined additional number of printed dots Cb is reached at point V after the actual toner usage passes a value of 83%. When the predetermined additional number of printed dots Cb is reached at point V, the CPU 1 sets the toner usage on display to 100%. Alternatively, the CPU 1 may switch the toner usage on display from 95% to 100% a predetermined additional number of printed dots after the toner usage on display has reached 95%.

When printing is performed at a print duty smaller than 5%, if the toner usage on display assumes that printing is being performed at a duty of 5%, then the toner usage on display follows the line shown by points A, B, C, D, E, F, and G, so that the toner usage on display excessively differs from the actual toner usage. However, because the toner usage on display is forcibly set to 83% as soon as the actual toner usage reaches 83%, the difference between the actual toner usage and toner usage on display can be small after the toner usage on display was forcibly set to a value of 83%.

The operation will be described in more detail.

Because the amount of toner consumed for each dot is smaller at a print duty below 5% than at a duty of 5%, the amount of toner actually consumed increases at a lower rate than the toner usage on display. Therefore, when the actual toner usage reaches point B (i.e., somewhat before the toner-low level $A_L$), the operation of step S106 of FIG. 8 is performed. That is, the CPU 1 controls the display unit 20 to display "80%," and then halts updating the toner usage on display. In other words, the toner usage on display remains "80%." In this manner, the toner usage on display is prevented from deviating from the actual toner usage by a large amount.

If the CPU 1 does not halt updating the toner usage displayed on the display unit 20 after point B, the toner usage on display continues to increase so that the toner usage on display will be about 88% when the toner-low level $A_L$ is detected at point J. Thus, upon detection of the toner-low level $A_L$ at point J, the toner usage on display would be switched from "88%" to "83%." This abnormal change in toner usage on display is confusing to the user.

Then, printing is performed further. When the toner-low level $A_L$ is detected at point J, the operation of step S109 of FIG. 8 is performed. That is, the CPU 1 sets the accumulated number of dots to a value (A/a)×0.83 corresponding to the actual toner usage at which the toner-low level $A_L$ is detected, and controls the display unit 20 to display "83%" so that the toner usage on display accurately reflects the actual toner usage.

Then, further printing is performed. When the toner usage on display reaches point U at which the toner usage is 95% (i.e., somewhat before "100%"), the CPU 1 halts updating the toner usage displayed on the display unit 20. In other words, the toner usage on display remains "95%." Then, printing is performed still further. When the current accumulated number of dots exceeds an accumulated number of dots that corresponds to the toner-low level $A_L$, by more than a predetermined value Cb, the CPU 1 determines that the toner has exhausted (i.e. "toner-empty"), and switches the display from "95%" to "100%" at point V.

As described above, if printing operations at a print duty above 5% and printing operations at a print duty below 5% are randomly performed, the toner usage on display does not change at the same rate as the actual toner usage. Despite this fact, when the toner-low level $A_L$ is detected, an accurate toner usage can be displayed by executing steps S105, S106, and S111.

In the first embodiment, the total number of dots is calculated based on the total amount of toner available for printing shortly after a new, unused toner cartridge 101 has been attached to the image forming apparatus 200. For example, if the toner cartridge 101 has a corresponding Radio Frequency Identification (RFID) that uniquely identifies the toner cartridge and the image drum unit 102 or the image forming apparatus 200 is provided with a reading section for reading the RFID, then the total number of dots may be determined as follows:

If an RFID that is read by the reading section from a toner cartridge is different from the previous RFID, then it is determined that a new, unused toner cartridge has been attached to the image drum unit 102 or the apparatus 200. A new total number of dots M can be determined as follows:

$$M=Mc+Mfr$$

where Mc is the number of dots corresponding to the initial amount of toner held in the new, unused toner cartridge, and Mfr is the number of dots corresponding to the remaining toner in the previous toner cartridge.

Mfr is calculated as follows:

$$Mfr=Mmf-Mf$$

where Mmf is the number of dots corresponding to the initial amount of toner held in the previous toner cartridge and Mf is the accumulated number of dots before the previous toner cartridge is unloaded from the image drum unit 102 or the apparatus 200.

For example, the toner usage is "95%" for Mmf=200 and Mf=1900. The resulting total number of dots Mm that can be printed is given by Mm=Mc+Mfr. In this manner, the resulting total number of dots Mm on display accurately reflects the remaining toner in the toner reservoir 102.

Even if the toner usage on display tends to deviate from the amount of toner actually consumed due to the change in print duty, the toner usage on display can be corrected properly such that the toner usage on display is accurate enough when the remaining toner has just passed the toner-low level $A_L$. Further, the CPU 1 halts updating on the toner usage displayed on the display unit 20 at a point somewhat before "100%." Then, when the CPU 1 detects the "toner-empty" state, the CPU 1 sets the toner usage on display to "100%." Therefore, even if the toner consumption rate differs from what it was estimated, there will not be a large difference between the toner usage on display and the amount of toner actually consumed. This prevents the user from being confused, and allows the user to know the toner usage accurately.

Second Embodiment

In a second embodiment, it is assumed that cyan toner is consumed at a rate 1.15 times that of black toner. Therefore, the initial amount of cyan toner held in a new, unused cyan toner cartridge is 1.15 times that of the black toner cartridge.

The configuration of the hardware according to the second embodiment is exactly the same as that of the first embodiment in FIGS. 1-3.

Figure 12:
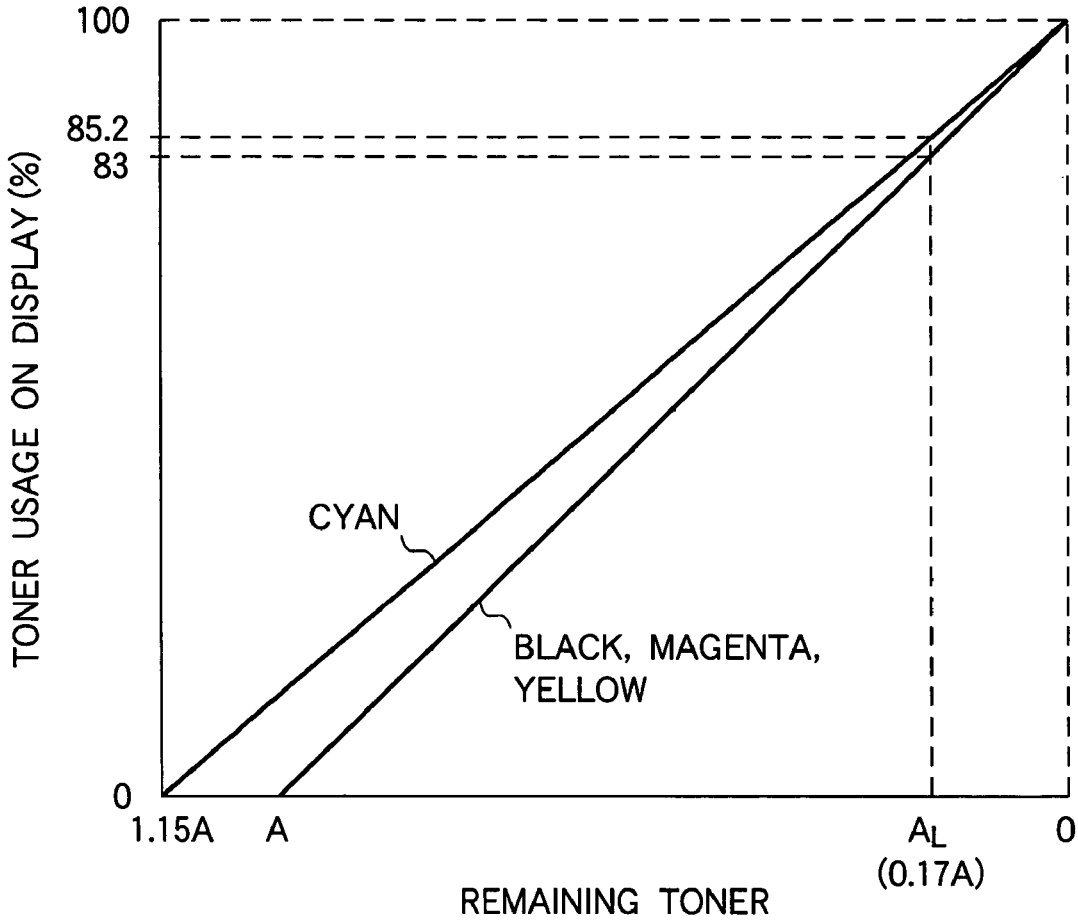
FIG. 12 illustrates the relation between the remaining toner in a toner reservoir and the toner usage on display.

FIG. 12 illustrates the relation between the remaining toner in the toner reservoir 102*a* and the toner usage on display. In the second embodiment, the initial amount of the black, magenta, and yellow toners is A. The initial amount of the cyan toner is 1.15 times A. The cyan toner is consumed at 1.15 times higher rate than the black, magenta, and yellow toners. Thus, if printing is performed at the same printing duty, the cyan toner is exhausted when the black, magenta, and yellow toners are exhausted. As is clear from the two graphs in FIG. 12, when the toner-low level $A_L$ is detected, the actual toner usage is 83% for the black, magenta, and yellow toners and 85.2% for the cyan toner.

Referring to FIG. 12, the actual toner usage of cyan toner can be calculated as follows: When the toner-low level $A_L$ is detected, the actual toner usage of cyan toner used is equal to 1.15A−0.17A. The actual toner usage of cyan toner used (i.e., 1.15A−0.17A) in percentage is $\{(1.15A-0.17A)/1.15A\}\times 100=85.2\%$.

Figure 13:
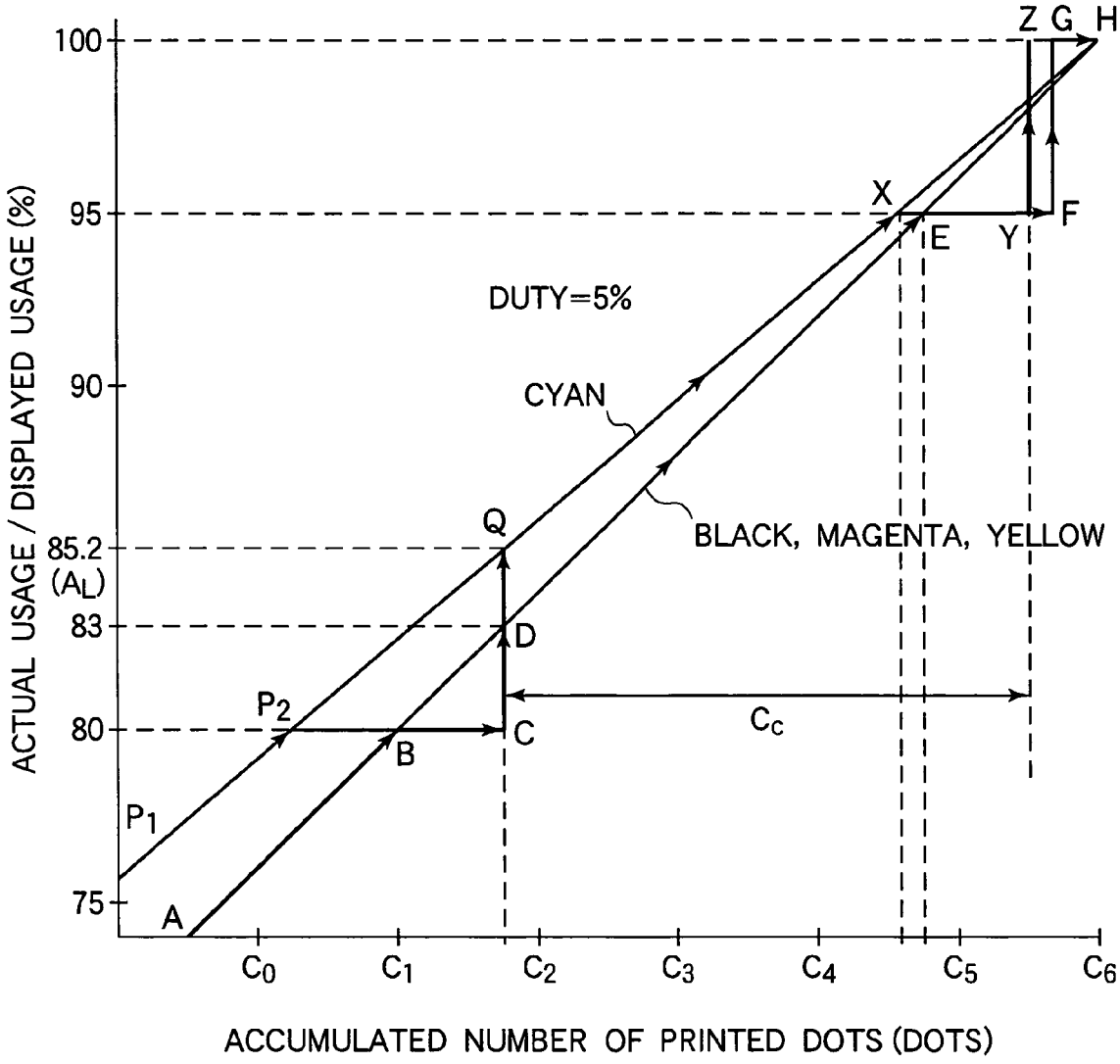
FIG. 13 illustrates the relationships between the remaining toner and the cyan toner usage when printing is performed at a print duty of 5%.

FIG. 13 shows a graph that illustrates the relationship between toner usage and the number of printed dots for a print duty of 5%. Referring to FIG. 13, when printing is performed at a print duty of 5% using black, magenta, or cyan, the actual toner usage follows the line shown by points A, B, D, E, and H. The displayed toner usage is calculated as a function of the accumulated number of printed dots and follows points A, B, C, D, E, F, and G.

When printing is performed at a print duty of 5% using cyan toner, the actual toner usage of cyan follows the line shown by points P1, P2, B, C, D, Q, X, Y, and Z. When the accumulated number of printed dots reaches point P2, the CPU 1 halts updating the toner usage on display. When the toner-low level $A_L$ is detected, i.e., the actual toner usage reaches point Q, the actual toner usage of cyan reaches 85.2% (point Q). Thus, the CPU 1 forcibly sets the toner usage on display to 85.2% (point Q).

Thereafter, the CPU 1 continues to calculate the toner usage on display based on the additional number of printed dots, and updates the toner usage on display continually, so that the toner usage on display follows the line shown by points Q and X.

When the toner usage on display reaches 95% (point X), the CPU 1 halts updating the toner usage on display until a predetermined additional number of printed dots Cc is reached after the toner usage on display passed a value of 85.2%. When the predetermined additional number of printed dots Cc is reached at point Y, the CPU 1 forcibly sets the toner usage on display to 100%. Alternatively, the CPU 1 may switch the toner usage on display from 95% to 100% a predetermined additional number of printed dots after the toner usage on display has reached 95%.

The operation will be described in more detail.

For the black, yellow, or magenta toner, the toner usage will be displayed as follows: When the actual toner reaches point B (i.e., somewhat before a toner-low level $A_L$) as a result of printing operations performed, the operation of step S106 of FIG. 8 is performed to prevent the toner usage on display from becoming too large a value as compared to the actual toner usage.

Thereafter, when the toner-low level $A_L$ is detected at point C, the operation of step S109 of FIG. 8 is performed. That is, the CPU 1 sets the accumulated number of dots to a value $(A/a)\times 0.83$ corresponding to the toner usage at which the toner-low-level $A_L$ is detected, and then controls a display unit 20 to display "83%," so that the toner usage on display accurately reflects the actual toner usage.

When the toner usage on display reaches point E at which the toner usage is 95%), somewhat before "100%", the CPU 1 halts updating on the toner usage displayed on the display unit 20. In other words, the display remains "95%." Then, further printing is performed. When the accumulated number of dots exceeds an accumulated number of dots that corresponds to the toner usage at which the toner-low level $A_L$ is detected, by more than a predetermined value, the CPU 1 determines that the toner has exhausted (i.e. "toner-empty"), and switches the toner usage on display from "95%" to "100%".

For the cyan toner, the toner usage will be displayed as follows: Cyan toner is consumed at a rate 1.15 times that of black toner. Therefore, the initial amount of cyan toner held in a new, unused cyan toner cartridge is $1.15\times A$.

As printing is performed, the toner usage on display passes point P1, somewhat before the toner-low level $A_L$. When the toner usage reaches point P2, the operation of step S106 of FIG. 8 is performed. That is, the value "80%" continues to be displayed until toner-low level $A_L$ is detected.

Printing is further performed. The toner-low level $A_L$ is detected at point Q, and the operation of step S109 of FIG. 8 is performed. That is, the CPU 1 sets the accumulated number of dots (i.e. 85.2%) to the toner usage. In other words, the toner usage on display is corrected from "80%" to "85.2%." In this manner, the toner usage on display reflects the actual toner usage with a minimum error.

When the toner usage on display reaches point X at which the toner usage is 95%, the CPU 1 halts updating the toner usage displayed on the display unit 20. In other words, the toner usage on display continues to be "95%." Then, further printing is performed. When the accumulated number of dots exceeds the number of dots when the toner-low level $A_L$ is detected, by more than a predetermined value, the CPU 1 determines that the toner has exhausted (i.e. "toner-empty") and switches the display from "95%" to "100%" (point Y).

Figure 14:
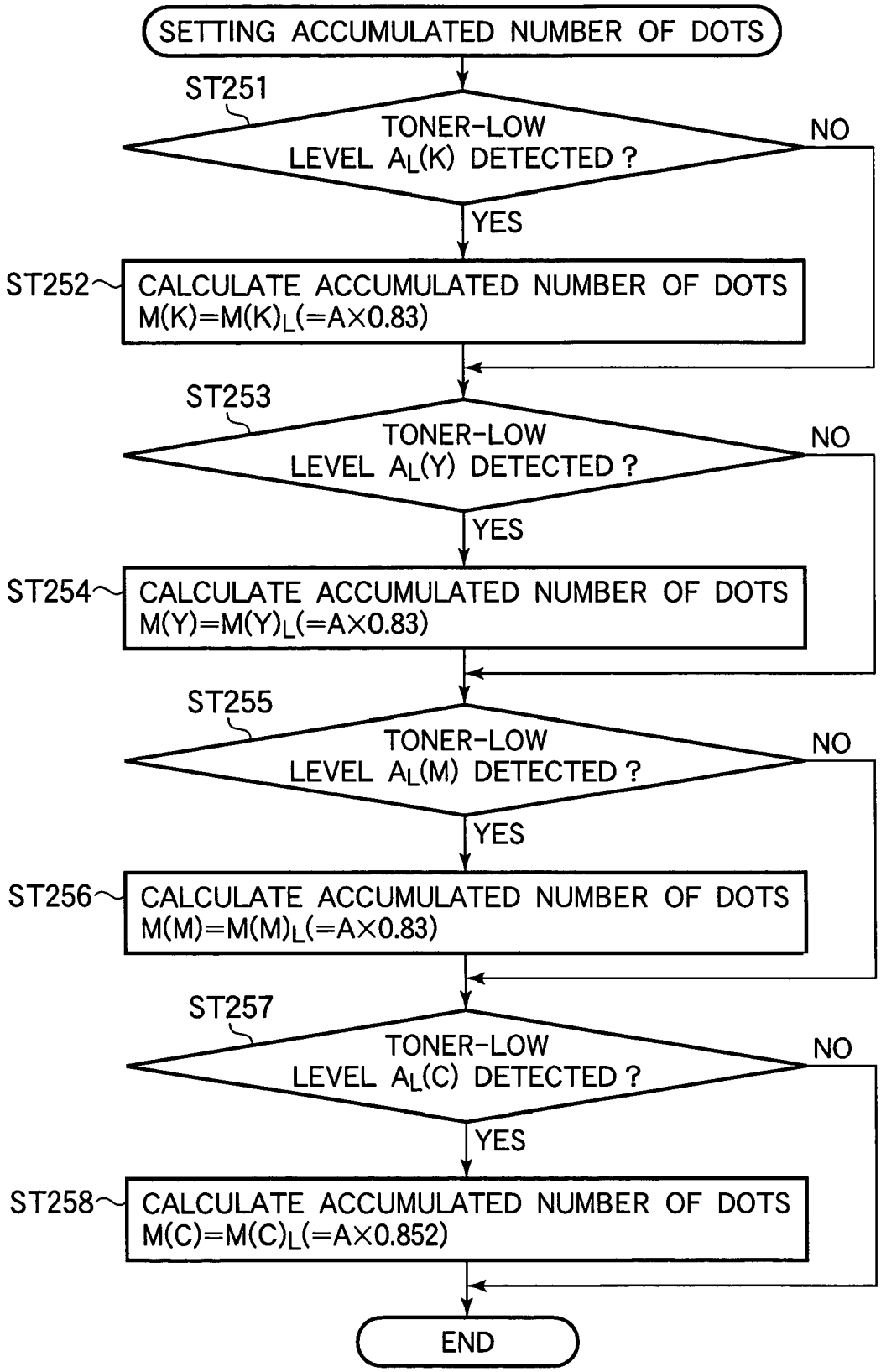
FIG. 14 shows a flowchart illustrating the procedure for displaying the toner usage of respective colors.

FIG. 14 shows a flowchart illustrating the procedure for displaying the toner usage of the respective colors. $A_L(Y)$, $A_L(M)$, $A_L(C)$, and $A_L(K)$ denote the toner-low levels of yellow, magenta, cyan, and black toners, respectively. Mm (Y), Mm (M), Mm (C), and Mm (K) denote the total number of dots of yellow, magenta, cyan, and black toners, respectively. M (Y), M (M), M (C), and M (K) denote the accumulated number of dots of yellow, magenta, cyan, and black, respectively.

The procedures for displaying the toner usage on the display unit 20 is the same as that described with reference to FIG. 8 in the first embodiment. The procedures for counting the number of printed dots is the same as that described with reference to FIG. 6 in the first embodiment.

The flowchart in FIG. 14 illustrates the procedure for setting the accumulated number of dots M for each color. When a toner-low sensor 108 detects that the remaining toner in an image drum unit 102 reaches the toner-low level $A_L$, the CPU 1 activates the flowchart in FIG. 4 for setting the accumulated number of dots.

A check is made to determine whether the toner-low level $A_L$ in a process unit 204 for black has been detected (step S251). If the answer is YES, the CPU 1 calculates the accumulated number of dots $M(K)=(A/a)\times 0.83$ corresponding to the toner usage at which the toner-low level $A_L$ is detected (step S252). If the answer is NO at step S251, the program proceeds to step S253.

A check is made to determine whether the toner-low level $A_L$ has been detected in a process unit 201 for yellow (step S253). If the answer is YES, the CPU 1 calculates the accumulated number of dots $M(Y)=(A/a)\times 0.83$ corresponding to the toner usage at which the toner-low level $A_L$ is detected (step S254). If the answer is NO at step S253, the program proceeds to step S255.

A check is made to determine whether the toner-low level $A_L$ in a process unit 202 for magenta has been detected (step S255). If the answer is YES, the CPU 1 calculates the accumulated number of dots $M(M)=(A/a)\times 0.83$ corresponding to the toner usage at which the toner-low level $A_L$ is detected step S256). If the answer is NO at step S255, the program proceeds to step S257.

A check is made to determine whether the toner-low level $A_L$ in a process unit 203 for cyan has been detected (step S257). If the answer is YES, the CPU 1 calculates the accumulated number of dots $M(C)=\{(A\times 1.15)/(a\times 1.15)\}\times 0.852$ corresponding to the toner usage at which the toner-low level $A_L$ is detected step S258). If the answer is NO at step S257, the program ends.

As described above, upon detection of the toner-low level $A_L$, the toner usage on display is set in accordance with toner consuming rate of the respective color. Thus, even if an amount of toner consumed per dot varies depending on the color, accurate display of the toner usage can be maintained. This prevents the user from making mistakes in determining whether the toner cartridge should be replaced, so that printing is not performed with toner reservoir empty or the toner cartridge is not replaced before it is not exhausted.

The first and second embodiments have been described in terms of an electrophotographic image forming apparatus. The present invention is not limited to this and may be applicable to other apparatuses such as a complex apparatus of color copying machine/color printer and a color FAX terminal. While the embodiments have been described in terms of the display of the remaining toner in an electrophotographic printer but may also be applied to the displaying of remaining ink in an ink cartridge of an ink jet printer.

What is claimed is:

1. An image forming apparatus, comprising:

a developer reservoir that holds a predetermined amount of developer therein;

a detector that detects when the developer decreases from the predetermined amount of developer to a first amount;

a computing section that computes an accumulated amount of consumed developer based on print data;

a display unit; and a controller that controls said display unit;

wherein said controller controls said display unit to display first information based on the accumulated amount of consumed developer until said detector detects the first amount; and wherein when said detector detects the first amount, said controller controls said display unit to display second information based on the first amount.

2. The image forming apparatus according to claim 1, wherein said computing section includes:

a counting section that counts a current accumulated number of printed dots when an image is formed; and a storing section that stores the current accumulated number of printed dots;

wherein when said detector detects the first amount, said controller stores a predetermined number of dots into said storing section, the predetermined number of dots corresponding to the first amount.

3. The image forming apparatus according to claim 1, wherein when the accumulated amount of consumed developer reaches to a first value smaller than the amount of developer that corresponds to the first amount, said controller controls said display unit to continue to display the first value until the first amount is detected.

4. The image forming apparatus according to claim 3, wherein when the accumulated amount of consumed developer reaches to a second value larger than the amount of developer that corresponds to the first amount, said controller controls said display unit to display the second value until the accumulated amount of consumed developer reaches a third value larger than the second value;

wherein when the accumulated amount of consumed developer exceeds the third value, said controller controls said display unit to display information representing that the developer reservoir is empty of the developer.

5. The image forming apparatus according to claim 1, wherein the second information indicates an amount of developer that has been actually consumed until the first amount is detected.

6. The image forming apparatus according to claim 1, wherein the second information indicating a difference between the predetermined amount of developer and the first amount.

7. An image forming apparatus, comprising:

a plurality of detectors each of which detects when developer held in a corresponding one of a plurality of developer reservoirs decreases to a first amount;

a computing section that computes current accumulated amount of consumed developer held in each one of the plurality of developer reservoirs, the accumulated amount of consumed developer being based on print data;

a display unit;

a controller that controls said display unit;

wherein said controller controls said display unit to display first information based on the accumulated amount of consumed developer until each of the plurality of detectors detects the first amount; and wherein when said detector detects the first amount, said controller controls said display unit to display second information based on the first amount.

8. The image forming apparatus according to claim 7, wherein said computing section includes:

a counting section that counts a current accumulated number of printed dots when an image is formed using the developer in a corresponding one of the plurality of developer reservoirs; and a storing section that stores the current accumulated number of printed dots counted by said counting section;

wherein when each of the plurality of detectors detects the first amount, said controller stores a number of dots into said storing section, the number of dots corresponding to the first amount.

9. The image forming apparatus according to claim 8, wherein the plurality of developer reservoirs hold toners of different colors.

10. The image forming apparatus according to claim 9, wherein one of the plurality of developer reservoirs holds a larger amount of developer of a corresponding color than the others of the plurality of developer reservoirs.

11. The image forming apparatus according to claim 10, wherein the plurality of developer reservoirs hold black toner, yellow toner, magenta toner, and cyan toner, respectively.

12. An image forming apparatus, comprising:

a developer reservoir that holds a predetermined amount of developer therein;

a detector that detects when the developer decreases from the predetermined amount of developer to a first amount;

a computing section that computes a remaining amount of developer based on print data;

a display unit; and a controller that controls said display unit;

wherein said controller controls said display unit to display first information based on the remaining amount of developer until said detector detects the first amount; and wherein when said detector detects the first amount, said controller controls said display unit to display second information based on the first amount.

* * * * *